US006056310A

United States Patent [19]

Hangl

[11] Patent Number: 6,056,310

[45] Date of Patent: May 2, 2000

[54] MEANS FOR SECURING A SNOWBOARD OR SKI TO THE BOOT OF A SNOWBOARDER OR SKIER

[76] Inventor: Andreas Hangl, Chasa Val Maisas, CH-7563 Samnaum, Switzerland

[21] Appl. No.: 08/765,506

[22] PCT Filed: May 13, 1996

[86] PCT No.: PCT/CH96/00182

§ 371 Date: Mar. 5, 1997

§ 102(e) Date: Mar. 5, 1997

[87] PCT Pub. No.: WO96/35488

PCT Pub. Date: Nov. 14, 1996

[30] Foreign Application Priority Data

May 12, 1995 [CH] Switzerland ..... 1384/95
Oct. 20, 1995 [CH] Switzerland ..... 2973/95

[51] Int. Cl.[7] ..... A63C 9/08

[52] U.S. Cl. ..... 280/607; 280/602; 280/618

[58] Field of Search ..... 280/607, 617, 280/618, 636, 602

[56] References Cited

U.S. PATENT DOCUMENTS 3,797,839 3/1974 Smolka et al. ..... 280/617
4,067,593 1/1978 Earl ..... 280/617
5,135,250 8/1992 Abondance et al. ..... 280/618 X
5,474,321 12/1995 Pritz ..... 280/617 X

FOREIGN PATENT DOCUMENTS 0 498 053 8/1992 European Pat. Off. .
2 657 025 7/1991 France .
91/16957 11/1991 WIPO .
95/00217 1/1995 WIPO .

*Primary Examiner*—Michael Mar
*Attorney, Agent, or Firm*—Browdy and Neimark

[57] ABSTRACT

A transmission device (100) for a snowboard comprises a longitudinal base plate (101) to which is fitted a binding (11, 12) for a boot (6) and two spacers (131, 132) allocated to the base plate (101) and the snowboard body (1). The spacers (131, 132) are fitted in the central longitudinal region of the base plate (101) and are themselves a distance (F) apart. The base plate (101) has downwardly directed and longitudinally running ribs (105). The spacers (131 and 132) have a U-shaped cross-section with a base (133) and arms (134, 135). The base plate (101) lies on the base (133) and between the arms (134, 135) of the spacer. The base plate (101) and the spacers (131, 132) are secured to the snowboard body (1) by screws (141, 142).

17 Claims, 10 Drawing Sheets

180
181
182
183
185
186
187
191
192
193
194
195
196
197
198
199

MEANS FOR SECURING A SNOWBOARD OR SKI TO THE BOOT OF A SNOWBOARDER OR SKIER

BACKGROUND OF THE INVENTION

1. Technical Field of the Invention

The present invention relates to a means for securing a snowboard or ski to the boot of the snow-boarder or skier.

2. Prior Art

A means of this generic type is already known and is disclosed in OE-C[sic] 299 030. This known means comprises a sole plate, on the upper side of which the binding parts are fastened. Projecting from the underside of the sole plate is a spacer piece whose underside is fastened on the body of the ski. The spacer-piece dimension in the longitudinal direction of the sole plate is smaller, by a multiple, than the length of the sole plate. The short spacer piece is intended to concentrate those forces originating from the ski boot on a small area of the narrowest part of the ski body, in order that the ski body can bend effectively during skiing.

The ski bodies are of different designs and the skis are used in different manners. Said rigid spacer piece cannot transmit the forces to the ski body such that said force transmission takes account of the properties of the respective ski-body design and/or of the desired skiing style.

OBJECT OF THE INVENTION

The object of the present invention is to eliminate these and additional disadvantages of the prior art.

BRIEF DESCRIPTION OF THE DRAWINGS

Embodiments of the present invention are explained in more detail hereinbelow with reference to the accompanying drawings, in which.

DETAILED DESCRIPTION OF THE PREFERRED EMBODIMENT(S) OF THE INVENTION

Figure 1:
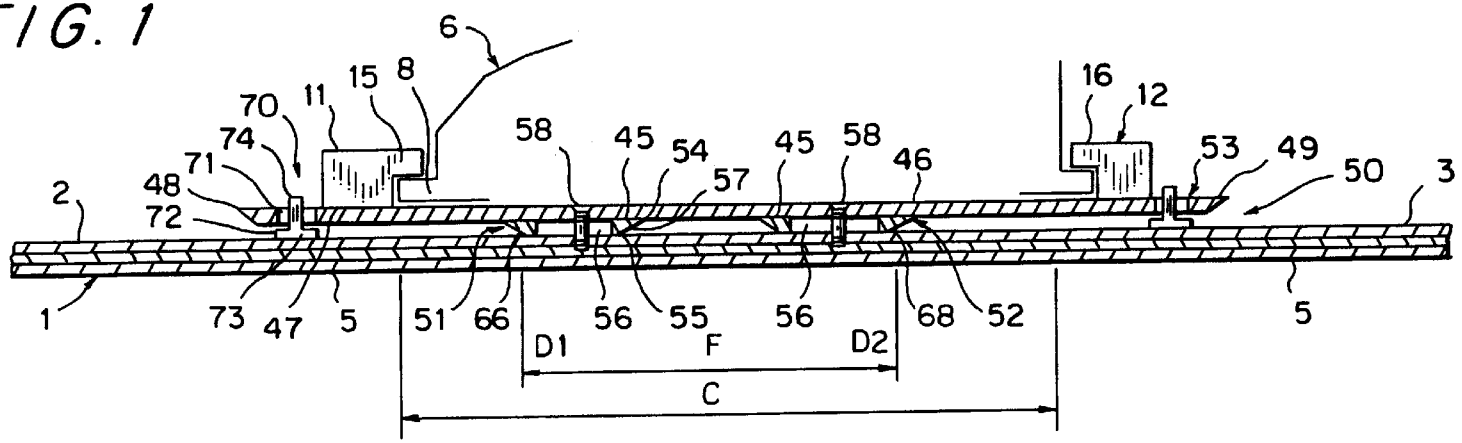
FIG. 1 shows, partially in vertical section, a detail of a central region of a ski which is provided with a first embodiment of the means according to the invention.
Figure 2:
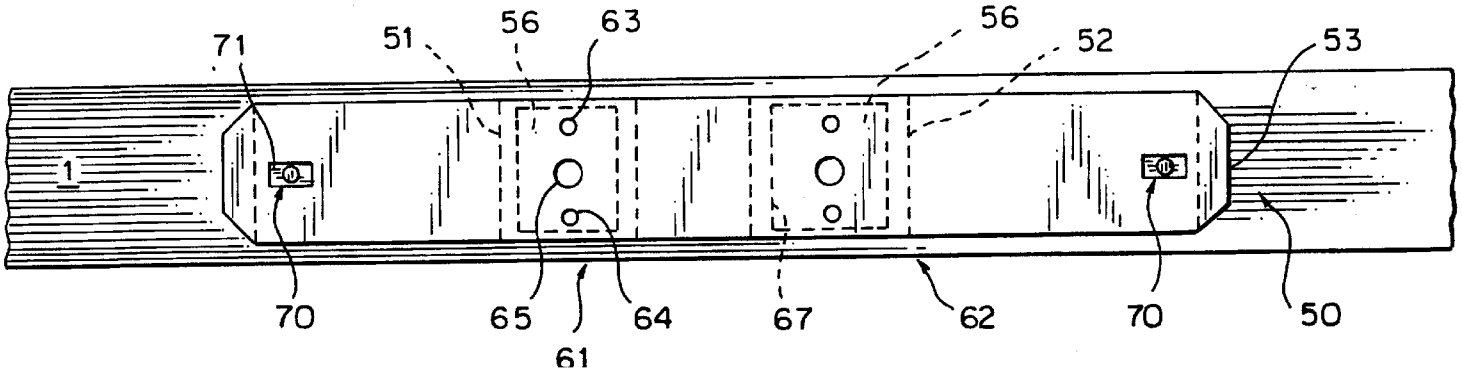
FIG. 2 shows a plan view of the essential parts of the means from FIG. 1.

FIG. 1 illustrates, partially in vertical section, a detail from an alpine ski, while FIG. 2 shows a plan view of the essential parts from FIG. 1. The body 1 of the ski has a front part 2 and a rear part 3, FIGS. 1 and 2 illustrating in each case only that section of each of said end parts 2 and 3 which adjoins the central part 5 of the ski body 1. The ski-body end parts 1 and 2 are wider than the central part 5. The ski body 1 is provided with a means for securing the ski body 1 to a ski boot 6 (FIG. 1).

The securing means also comprises, inter alia, a ski binding which is known per se and has a front binding 11 and a rear binding 12. Both the front binding 11 and the rear binding 12 have horizontally running protrusions 15 and 16, respectively, which are known per se. The ski boot 6 has an upper 7 and a sole 8 which adjoins said upper 7 and is of a design which is known per se, the sole 8 having end extensions, which are likewise known per se, at the front and rear. The protrusions 15 and 16 of the ski binding grip over the upper side of the end extensions of the sole and lie above the latter. C indicates, in FIG. 1, the distance between the binding parts 11 and 12 or the length of the ski boot 6.

The securing means in question further comprises a device 50 which is designed such that it can transmit those forces which originate from the ski boot 6 into the narrowest region 5 of the width of the ski body 1. This transmission device 50 comprises two flat spacer pieces 51 and 52 and a base plate 53.

The spacer pieces 51 and 52 are arranged between the ski body 1 and the base plate 53 and are spaced apart from one another by a distance F which is smaller than the length C of the sole 8 of the ski boot 6, or than the distance C between the front binding 11 and the rear binding 12. The spacer pieces 51 and 52 are fitted on the upper side of the ski body 1 such that they can be displaced and fixed in the longitudinal direction of said ski body 1.

The respective spacer piece 51 or 52 has a basic body 45 comprising an essentially cuboidal piece of material, which may be metal or plastic. One of the base surfaces 55 of the spacer piece 51 or 52 rests on the upper side of the ski body 1. The other base surfaces 54 of the spacer piece 51 or 52 is assigned to the underside of the base plate 53.

At least one through-opening 56 is made in the basic body 45 of the spacer piece 51 or 52 and extends between the base surfaces 54 and 55 of the spacer piece, this opening 56 opening out in the base surfaces 54 and 55 of the basic body 45. The cross section of the opening 56 may be circular, square, elongate or the like, the walls of said opening 56 expediently being perpendicular to the base surfaces 54 and 55. If the opening 56 is elongate, then the longer dimension of this opening 56 extends parallel to the length of the ski body 1. In the case illustrated, the cross section of the opening 54 is square.

The spacer piece 51 or 52 has four outer side walls 57. These outer walls 57 may be at right angles to the base surfaces 54 and 55 of the spacer piece 51 or 52. In the case illustrated, however, the outer side walls 57 run obliquely with respect to said spacer-piece base surfaces 54 and 55, with the result that the spacer pieces 51 and 52 have the external shape of a truncated pyramid in which the smaller base surface 55 is located at the bottom. The larger base surface 54 of the spacer pieces 51 and 52 faces, or is assigned to, the base plate 53.

The base plate 53 is designed as an elongate plate, the longitudinal direction of which coincides with the longitudinal direction of the ski body 1. In this case, the base plate 53 is at least long enough for the front binding 11 and the rear binding 12 to be located on this plate 43. The upper side 46 and the underside 47 of the base plate 53 are planar and run virtually parallel to one another. At least two openings 65 are made in the central region of the base plate 53, these openings being located one behind the other in the longitudinal direction of said base plate 53. Screws 58 pass through these openings 65 and can assist the operation of fixing the base plate 53 on the ski body 1 with the interposition of the spacer pieces 51 and 52.

In the case illustrated in FIG. 2, the base plate 53 is provided with two groups 61 and 62 of openings and/or bores, these groups being located one behind the other in the longitudinal direction of the plate 53. The respective group 61 or 62 comprises two lateral bores 63 and 64, each of which is located nearer to one of the side edges of the base plate 53, as well as a central bore 65, which is arranged between the lateral bores 63 and 64, approximately in the center of the width of the base plate 53. In each case one screw 58 passes through the lateral bores 63 and 64 and additionally passes through the opening 56 in one of the spacer pieces 51 and 52.

A distance or clearance is provided between the inner walls 67 of the opening 56 in the spacer pieces 51 and 52 and the screws 58, with the result that the spacer pieces 51 and 52 can, if required, be displaced individually, with respect to the ski body 1 and the base plate 53 of the transmission device 50, in the longitudinal direction and/or transverse direction of the ski body 1. The set position of the respective spacer piece 51 or 52 with respect to the ski body 1 and the base plate 53 can be fixed by tightening the screws 58.

It is also possible, in this manner, to select or set the distance F between the spacer pieces 51 and 52, or the distance F between the outer edges 66 and 68 of the spacer pieces 51 and 52, or between the pressure points D1 and D2 on the ski body 1. With an adjustment, with respect to the ski body 1, of the position of the spacer pieces 51 and 52 spaced apart from one another by a constant distance, it is possible for the force from the ski boot 6 to be transmitted to various points on the ski body 1. The abovementioned possibilities for setting the transmission device 50 permit, inter alia, optimum coordination between the parameters of the respective ski and the capabilities of the skier using this ski.

The lateral bores 63 and 64 in the base plate 53 may also be designed as slots, the longitudinal direction of which runs perpendicularly to the longitudinal direction of the ski body 1. Such slots 63 and 64 permit lateral displacement of the base plate 53 toward one of the edges of the ski body 1. Such lateral displacement of the base plate 53 also causes the ski binding 11 and 12, which is fastened on at the base plate 53, to be displaced laterally with respect to the ski body 1. Such displacement makes it possible for the pressure to be concentrated optimally on the necessary zone of the inner edge of the controlling ski.

Since the base plate 53 is only connected to the ski body 1 in its central region, a guide device 70 is provided for the respective end part 48 or 49, which foresees from the respective binding part 11 or 12, respectively, of the base plate 53. Said guide device 70 comprises a slot 71 in the relevant end part 48 or 49 of the base plate 53, the longitudinal direction of this slot coinciding with the longitudinal direction of the base plate 53. The guide device 70 additionally comprises a guide piece 72 which comprises a foot plate 73 and a stub 74 which projects virtually at right angles from said foot plate 73. The diameter of the stub 74 is selected such that said stub 74 can be positioned in the slot 71 without play. The underside of the foot plate 73 is fastened on the upper side of the ski body 1 such that the stub 74 is located in the slot 71. The length of the stub 74 is such that the free end face of the stub 74 is located virtually in the plane of the upper side 46 of the base plate 73 when the ski body 1 is not subjected to loading.

When the ski is traveling through a curve, then the ski body 1 bends or the front of the ski 2 and the rear of the ski 3 bend toward the ends of the foot plate 73. At the same time, the stub 74 moves upward and in the longitudinal direction of the ski because the front of the ski 2 and the rear of the ski 3 respectively bend around the front edge 66 and around the rear edge 68 of the spacer pieces 51 and 52. In order to prevent the front of the ski 2 and the rear of the ski 3 from vibrating in this case, damping means (not illustrated) are arranged between the base plate 53 and the respective guide device 70.

Figure 3:
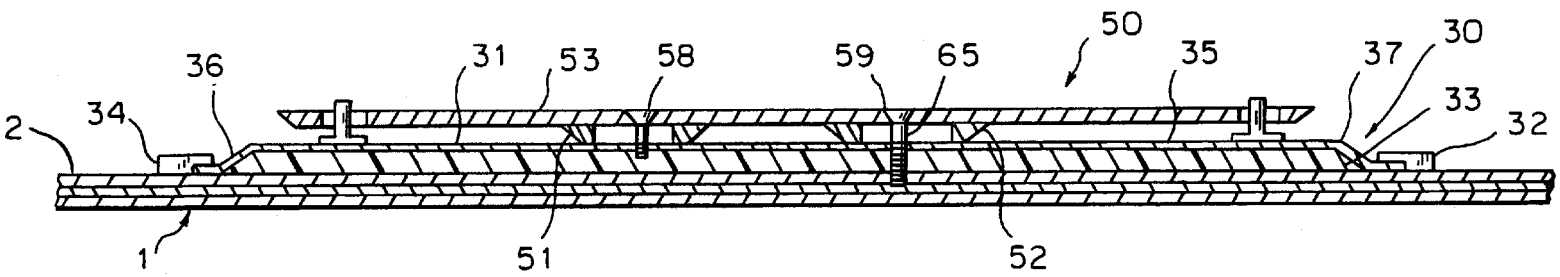
FIG. 3 shows a vertical section of a second embodiment of the means according to the invention.

The transmission device 50 which is depicted in vertical section in FIG. 3 largely corresponds to the device according to FIGS. 1 and 2. The main difference from FIGS. 1 and 2 is that the device 50 which is depicted in FIG. 3 also comprises a damping device 30. This damping device 30 contains an elongate cover plate 31 which is advantageously made of metal and which extends in the longitudinal direction of the ski body 1. The base plate 53 and the spacer pieces 51 and 52 are fastened on this cover plate 51 with the aid of screws 58. These screws 58 pass through the lateral openings 63 and 64 in the base plate 53 and through the spacer pieces 51 and 52.

The cover plate 31 has a main section 35 and end sections 36 and 37. The main section 35 runs in a rectilinear manner and lies in one plane. Each end section 36 or 37 of the cover plate 31 is made up of an oblique section and a lug. One end of the oblique section adjoins one end of the main section 35 and runs obliquely downward toward the ski body 1. The other end of the oblique section is adjoined by the lug, which runs virtually parallel to the main section 35. Said lug rests on the upper side of the ski body 1.

The rear end part 36 [sic] of the cover plate 31 is fastened on the ski body 1 with the aid of means 32 which are known per se, for example by means of at least one screw. Located in the front region of the cover plate 31 is a claw 34, which is fastened on the ski body 1 and grips over the front end 35 [sic] of the cover plate 31. When the ski body 1 bends, for example when it is traveling through a curve, the front end 35 [sic] of the cover plate 31 can slide beneath the claw 34.

The oblique sections 36 and 37 cause the main section 35 of the cover plate 31 to be spaced apart from the upper side of the ski body 1. The space between the main section 35 and the ski body 1 is filled with a damping plate 33 which is made of a compliant material. Since the damping layer 33 of this device 30 may, in certain circumstances, be comparatively soft and since the cover plate 31 of this device 30 is thin and, in addition, is only fastened at its rear end 36 [sic], a strengthening screw 59 passes through the respective central hole 65 on each of the groups 61 and 62 of openings of the base plate 53. These strengthening screws 59 are not only thicker, but also longer, than the lateral screws 58, with the result that the strengthening screws 59 pass through the damping device 30 and are only screwed in once they reach the ski body 1.

In order that the base plate 53 can also be displaced laterally with respect to the ski body 1, the central openings 65 in the base plate 53 are designed as slots. The longitudinal direction of these slots 65 is perpendicular to the longitudinal direction of the ski body.

Figure 4:
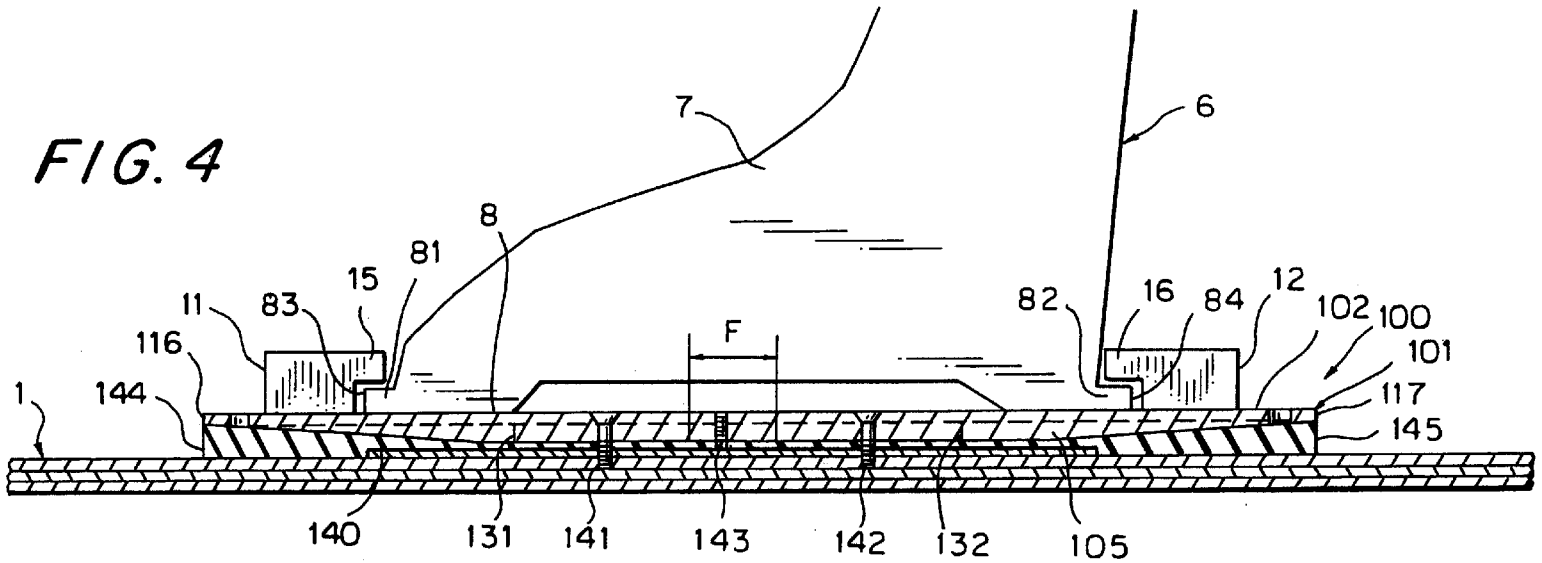
FIG. 4 shows, partially in vertical section, the central section of an alpine ski, said central section being equipped with a third embodiment of the means according to the invention.
Figure 5:
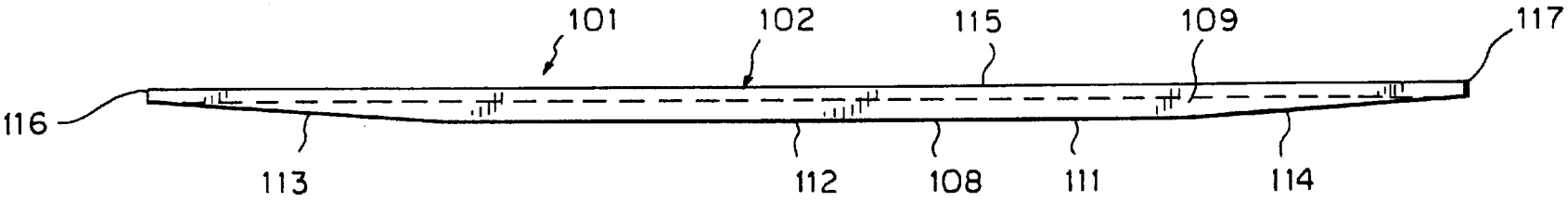
FIG. 5 shows a side view of a base plate of the means according to FIG. 4.
Figure 6:
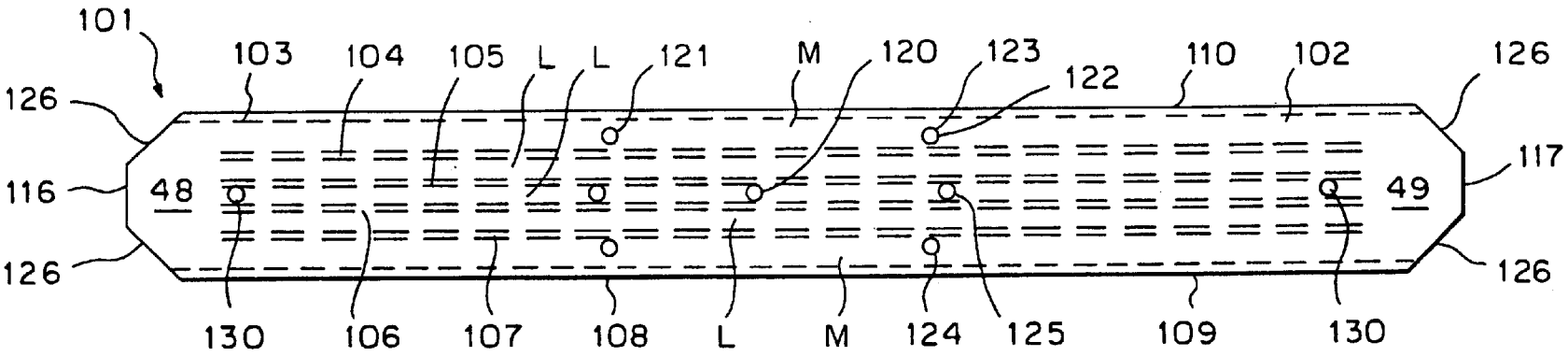
FIG. 6 shows a plan view of the base plate from FIG. 5.
Figure 8:
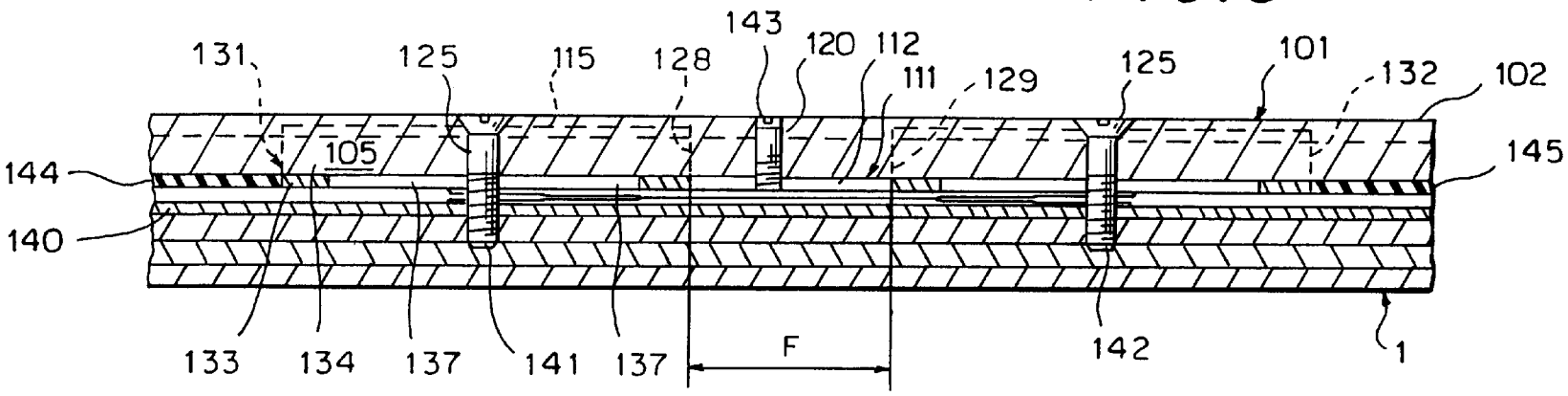
FIG. 8 shows an enlarged detail from the central part of the ski depicted in FIG. 4.
Figure 7:
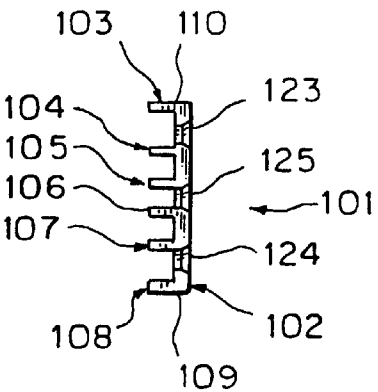
FIG. 7 shows a front view of the base plate from FIG. 5.

FIG. 4 shows a vertical section of the central section of an alpine ski. FIG. 8 shows an enlarged detail from the central part of the ski depicted in FIG. 4. The present embodiment of the transmission device 100 has an elongate base plate 101 (FIGS. 5 to 7). The width of said base plate 101 is approximately the same as the width of the central section 5 of the ski body 1, or the width of said base plate 101 is somewhat smaller than the width of the ski body 1 in this, narrowest, region 5. The base plate 101 has a plate-like part 102. The base plate 101 additionally has ribs 103, 104, 105, 106, 107 and 108 which project at right angles from the underside of the plate part 102.

The ribs 103 to 108 extend in the longitudinal direction of the plate part 102 and of the base plate 101 and of the ski body 1, and they are distributed over the width of the plate part 102. The ribs 103 to 108 are spaced apart from one another and run virtually parallel to one another and parallel to the longitudinal direction of the elongate base plate 101 of the transmission device 100. The ribs 103 to 108 have an essentially square cross section. In the case illustrated, the ribs 103 to 108 have a rectangular cross section, the respective rib adjoining the plate part 102 of the base plate 101 with its shorter side. The ribs 103 to 108 may be integral with the plate part 102.

The outer side surface 109 or 110 of the rib 103 or 108, these two ribs being located on the respective longitudinal border of the plate part 102, is lush with the abutting side edge of the plate part 102. The remaining four ribs 104 to 107 form a group located between the border ribs 103 and 108 and concentrated in the central region of the gap between the border ribs 103 and 108. The individual central ribs 104 to 107 are spaced apart by virtually the same distance L. However, this distance L is smaller than that distance M which is provided between the group of central ribs 104 to 107 and one of the outer ribs 103 or 108. It is possible to change the stiffness of the base plate 101 by changing the thickness of the plate part 102, the thickness, and the number, of the ribs 103 to 108, etc.

The narrow side 111 of the ribs 103 to 108, said narrow side being remote from the plate part 102, has sections 112, 113 and 114. The first section 112 of the rib edge 111 runs virtually parallel to the upper side 115 of the plate part 102, and this rib section 112 is longer than the remaining rib sections 113 and 114. The remaining sections 113 and 114 of the ribs 103 to 108 extend between the central rib section 112 and the relevant end 116 or 117, respectively, of the plate part 102. The rib end sections 113 and 114 run obliquely upward, i.e. slope upward from the central rib part 112 toward the associated end edge 116 or 117 of the plate part 102. In the case illustrated, the central ribs 104 to 107 are shorter than the outer ribs 103 and 108, with the result that the underside of the plate part 102 are in planar in the end regions 48 and 49 of said plate part 102. On the contrary, the outer ribs 103 and 108 only terminate once they reach the respective phase 126 of the end edge 116 or 117.

A bore 120, which is a threaded bore in the present case, is made approximately in the center of the plate part 102. In each case one group 121 and 122 of bores are made in the plate part 102 at a distance from said central bore 120. The respective group 121 or 122 comprises two outer bores 123 and 124 and a bore 125 located therebetween. The respectively outer bore 123 or 124 is located in the region of the wider gap M between one of the outer ribs 103 or 108 and the group of ribs 104 to 107. The opening 125 located between the outer openings 123 and 124 is arranged in the central gap L between the central ribs 105 and 106.

While the outer openings 123 and 124 are arranged on a common line which is at right angles to the longitudinal direction of the plate part 102, the opening 125 located therebetween is arranged so as to be offset away from this line toward the nearest end edge 116 or 117 of the plate part 102. The distance between the groups 121 and 122 of openings is smaller than the length of the central section 112 of the lower edge 111 of the ribs. The corner parts of the plate part 102 are provided with phases 126. The direction of the plate part 102 mounted on the ski body 1 coincides with the longitudinal direction of the ski body 1. In this case, the base plate 101 is long enough for it to be possible for the front binding 11 and the rear binding 12 to be fastened on said plate 101.

Figure 9:
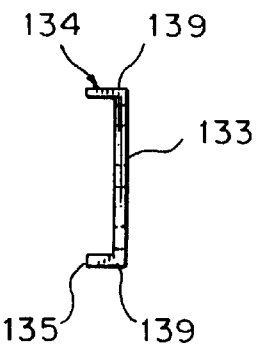
FIG. 9 shows a front view of a first embodiment of a spacer piece of the means according to FIG. 4.

The transmission device 100 further comprises two spacer or transmission pieces 131 and 132 which are arranged between the base plate 101 and the ski body 1. The respective spacer piece 131 or 132 has a U-shaped cross section (FIG. 9) with a base 133 and with legs 134 and 135. The spacer pieces 131 and 132 are assigned to the ski body 1, such that the outer side of the base 133 of the respective spacer piece 131 or 132 faces the upper side of the ski body 1. Consequently, legs 134 and 135 for the spacer piece 131 or 132 are directed upward and are located between the ribs 103 to 108 of the base plate 101.

Figure 10:
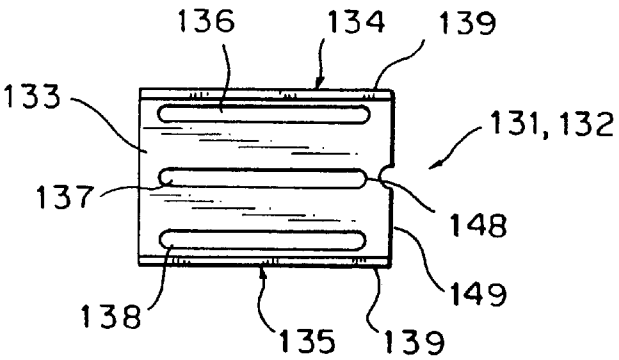
FIG. 10 shows a plan view of the spacer piece from FIG. 9.

Longitudinal openings or slots 136, 137 and 138 (FIG. 10) which run parallel to the longitudinal direction of the legs 134 and 135 are made in the base 133 of the spacer piece 131 or 132. The width of these slots 136 to 138 corresponds to the diameter of the openings 123, 124 and 125 in the base plate 102. The distance of the slots 136 to 138 from one another corresponds to the distance of the openings 123 to 125 from one another.

The distance of the legs 134 and 135 on the spacer piece 131 or 132 from one another is selected such that the outer surfaces 139 of the legs 134 and 135 on the spacer piece 131 or 132 may be located between the inner surfaces of the outer ribs 103 and 108 on the base plate 102. The height of the legs 134 and 135 is comparable to the height of the ribs 103 to 108 on the base plate 102.

In the case illustrated in FIG. 4, a pressure-distributing plate 140 is located on the upper side of the ski body 1. In such a case, the spacer pieces 131 and 132 are located on the distributing plate 140, although the spacer pieces 131 and 132 could also rest directly on the ski body 1. The base plate 101, the pressure-distributing plate 140 and the spacer pieces 131 and 132 may be made of various materials.

The base plate 102 and the spacer pieces 131 and 132 are retained on the ski body 1 with the aid of screws, or groups of screws, which pass through the groups 121 and 122 of openings and the slots 136 to 138 and are screwed into the ski body 1. The spacer pieces 131 and 132, or their mutually facing inner side edges 128 and 129, are spaced apart from one another by a distance F. It is possible to change this distance F by displacing the spacer pieces 131 and 132, which the slots 136 to 138 made in said spacer pieces 131 and 132 readily permit. The spacer pieces 131 and 132 can thus be displaced and fixed on the upper side of the ski body 1 in the longitudinal direction of the latter. This distance F between the spacer pieces 131 and 132 is smaller than the length of the sole 8 of the ski boot 6 or the distance between the front binding 11 and the rear binding 12. It is also possible to change and fix the position of the individual spacer piece 131 or 132 with respect to the ski body 1 or the base plate 102 with the aid of the screws 141 and 142.

Adjustment of the position of the spacer pieces 131 and 132 with respect to the ski body 1 makes it possible to select the length F of the force-transmission device 100 with respect to the narrowest part 5 of the ski body 1 and thus to set the desired skiing properties of the respective ski.

Since the spacer pieces 131 and 132 arranged on the ski body 1 are spaced apart from one another (FIGS. 4 and 8), that part of the lower edge 111 of the central section 112 of the ribs 103 to 108 which is located between the inner side edges 128 and 129 of the spacer pieces 131 and 132 is exposed. A further screw 143 passes through the central threaded opening 120 in the base plate 101, and its tip rests on the ski body 1 or on the pressure-equalizing plate 140. Said screw 143 is located between the spacer pieces 131 and 132 arranged on the ski body 1. When said central screw 143 is screwed in deeper, then that section of the ski body 1 which is located between the fastening screws 141 and 142 is bent downward. This is because, inter alia, the base plate 101 is extremely stiff as a result of the strengthening ribs 103 to 108. The front of the ski and the rear of the ski are forced upward. With the aid of the central screw 143, it is thus possible to change decisively the prestressing in the ski and thus also the skiing properties of the ski.

Since the underside 111 of the base plate 102 slopes upward in the end regions 48 and 49 of the same, snow could collect, between the base slate 102 and the ski body 1, in these regions of the base plate 102 and change the properties of the base plate 102 for skiing. In order to prevent this, inserts 144 and 145 made of a, for example, elastomeric material are located in these interspaces. A suitable selection of the material of these inserts 144 and 145 also makes it possible to control the prestressing in the ski and thus also the skiing properties thereof.

Figure 11:
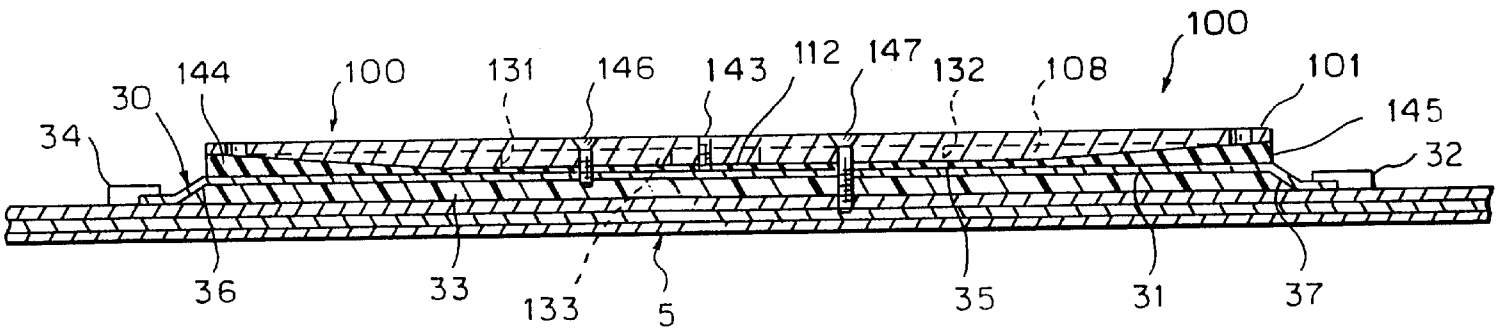
FIG. 11 shows a vertical section of the central section of an alpine ski, said central section being equipped with a fourth embodiment of the means according to the invention.

FIG. 11 shows a vertical section of the central section of an alpine ski, said central section being equipped with a further embodiment of the means according to the invention. This means has a damping device 30, which has already been described in conjunction with FIG. 3. The transmission device 100 described in conjunction with FIGS. 4 to 10 is fastened on the main section 35 of the damping device 30. The base 133 of the spacer pieces 131 and 132 of said device 100 is located between the planar main section 35 of the cover plate 31 of the damping device 30 and the central section 112 of the central ribs 104 to 107 on the base plate 101.

The transmission device also comprises at least one wedge 144 or 145 made of an elastomeric material. In each case one of these wedges 144 and 145 is arranged beneath the upwardly sloping end parts 113 and 114 of the base plate 102. FIG. 11 shows the wedges 144 and 145 in conjunction with the damping device 30. It goes without saying, however, that these wedges 144 and 145 may also be used independently of this damping device 30. may then be used. The wedges 144 and 145 are then located either directly in the upper side of the ski body 1 or on an equalizing or damping plate 140 which is arranged on the upper side of the ski body 1, beneath the means in question.

The main section 35 of the damping device 30 is provided with a central opening, in which the already described central screw 143 can be screwed in order, inter alia, to be able to control the prestressing of the ski. Openings in which screws 146 are screwed are made in that region of the main section 35 which is located in front of said central opening, and these screws 146 also pass through the openings 123 to 125 of the first group 121. However, the length of these screws 146 is such that they terminate in the damping material 33. Openings which correspond to the second group 122 of openings 123 to 125 in the base plate 101 are also made in said main section 35. Second screws 147 pass through these openings and extend into the ski body 1, where their ends are screwed in. These screws 147 secure the base plate 101 on the ski body 1. The screws 146 of the first group are thus sufficiently short to avoid obstructing bending of the ski body 1 which occurs during skiing.

Figure 12:
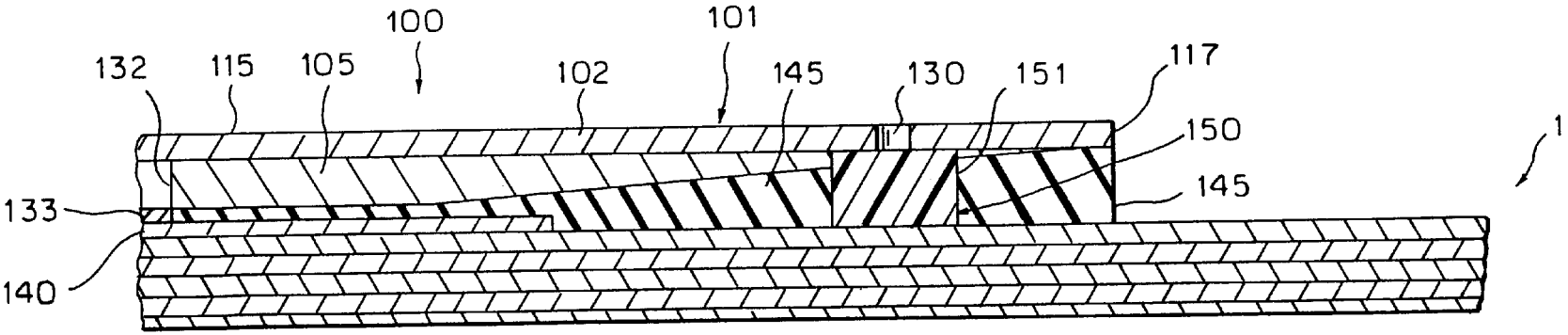
FIG. 12 shows a vertical section of a detail from a fifth embodiment of the present invention.

FIG. 12 shows a vertical section of a detail from a further embodiment of the present invention. A bore 130 is made at least in one of the end regions 48 or 49 of the base plate 101 and virtually in the center of the width of the same. As has been mentioned, the central ribs 104 to 107 terminate before the end regions 48 and 49, with the result that the underside of the base plate 101 is planar in the end regions 48 and 49. In each case one block 150 made of a damping material is located, beneath the bore 130, in the end regions 48 and 49 and is advantageously embedded or positioned in the damping insert or in the damping wedge 144 or 145.

The damping block 150 may be cuboidal, with the result that this block 150 fills the space between the ski body 1 and the underside of the base plate 101 over virtually the entire width of the ski body 1. It goes without saying that the block 150 may have a circular horizontal cross section. In the case illustrated, the distance between the bore 130 in the plate part 102 and the rear edge 117 of the plate part or of the base plate 101 is greater than half the dimension of the damping block 150 in the same direction. Consequently the outer side surface 151 of the damping block 150 is at a distance from the rear edge 117 of the base plate 101. The same applies if the damping block 150 is used, or is also used, in the region of the front edge 116 of the base plate 101.

The material of the damping block 150 may be elastomeric, in this case the material of the damping block 150 differing from the material of the damping wedges 144, 145. There are also plastics which, once they have been compressed, return to their original, noncompressed form in a delayed manner. Such damping materials may also be used in the damping block 150.

Figure 14:
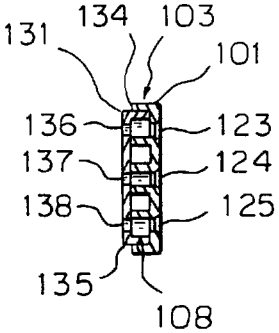
FIG. 14 shows a front view of the arrangement according to FIG. 13.
Figure 13:
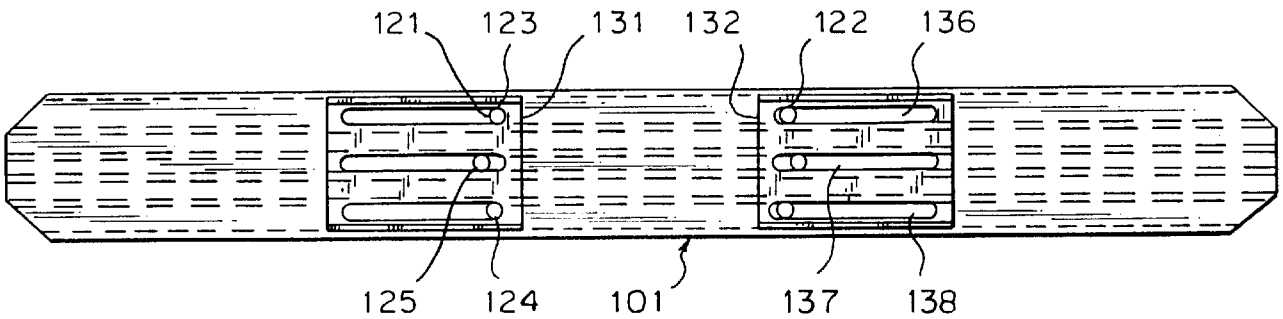
FIG. 13 shows a plan view of the base plate of the means acccording to FIG. 4, two spacer pieces being assigned thereto.

FIG. 13 shows a plan view of the base plate 101 of the means according to FIG. 4, two spacer pieces 131 and 132 being assigned to said base plate 101. FIG. 14 illustrates a front view of the arrangement from FIG. 13. It can be seen from FIG. 13 that the openings 123, 124 and 125 of the groups 121 and 122 on the base plate 101 are located in the region of, and over, the slots 136, 137 and 138 in the spacer pieces 131 and 132. This makes it possible for the fastening screws (not illustrated) to be able to pass both through the openings 123 to 125 in the base plate 101 and through the slots 136 to 138 in the spacer pieces 131 and 132. FIG. 13 illustrates the spacer pieces 131 and 132 in that position in which they are spaced apart by the greatest possible distance. The slots 136 to 138 make it possible for the spacer pieces 131 and 132 to be displaced along the base plate 101 in order to achieve optimum force transmission between the ski boot 6 and the ski body 1.

Figure 15:
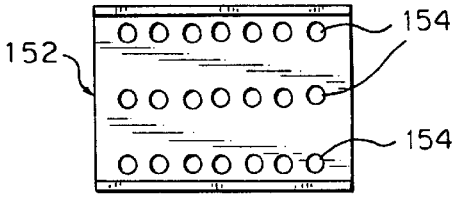
FIG. 15 shows a plan view of a second embodiment of the spacer piece.
Figure 16:
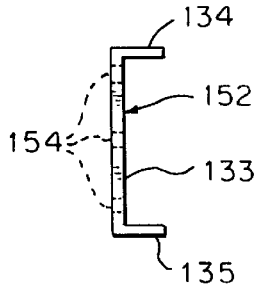
FIG. 16 shows a front view of the spacer piece from FIG. 15.

During the period over which this means is in use, the ski body 1 is bent with respect to the stiff base plate 101, which may affect the position of the spacer pieces 131 and 132 retained therebetween such that it is possible for their originally set position to change over time in an uncontrolled manner. In order to prevent this, a further embodiment of the spacer pieces is provided. One of these spacer pieces 152 is illustrated in plan view in FIG. 15. FIG. 16 shows a front view of this spacer piece 152. Instead of the slots shown in FIG. 10, this second spacer piece 152 has three comparatively closely situated rows of bores 154, the diameter of which is selected such that the fastening screws can pass through these openings 154. For setting the spacer piece 152, first of all the latter is moved into the desired position and then one of the fastening screws, inter alia, is also passed through the spacer-piece opening 154 located therebeneath and is screwed in.

Figure 17:
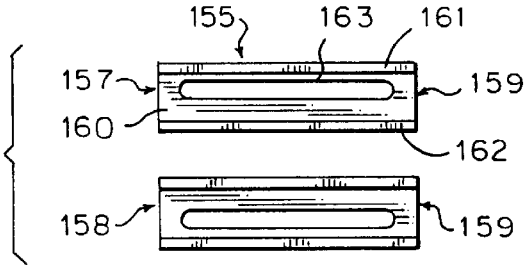
FIG. 17 shows a plan view of a first embodiment of a two-part spacer piece.
Figure 18:
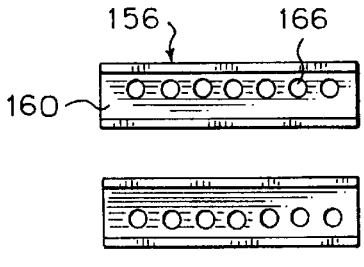
FIG. 18 shows a plan view of a second embodiment of a two-part spacer piece.
Figure 19:
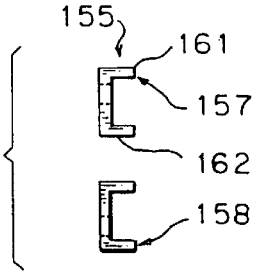
FIG. 19 shows a front view of the spacer piece from FIG. 17 or 18.

When the ski is traveling through a curve, then the radius of the curve of the inner ski is smaller than the radius of the outer ski, as is shown in practice. The skis then have the tendency to move apart from one another. When the means in question is used on skis which are markedly narrowed, said tendency is extremely noticeable. In order to counteract this, a two-part embodiment of the spacer pieces is provided (FIGS. 17 and 18). The spacer piece 155 comprises two parts 157 and 158 which have a basic body 159 with a U-shaped cross section (FIG. 19). The base 160 of the basic body 159 is adjoined by legs 161 and 162 of the U-profile. A slot 163 is made in the base 160 and corresponds to those slots 136, 137 and 138 which have been described in conjunction with FIG. 10.

Figure 23:
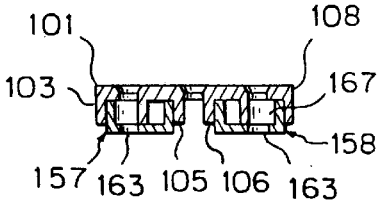
FIG. 23 shows a vertical section of a further embodiment of the arrangement from FIG. 20 with two-part spacer pieces, the section being taken perpendicularly to the longitudinal direction of this arrangement.
Figure 21:
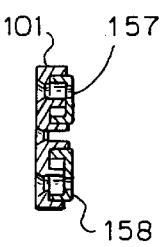
FIG. 21 shows a front view of the arrangement from FIG. 20.
Figure 20:
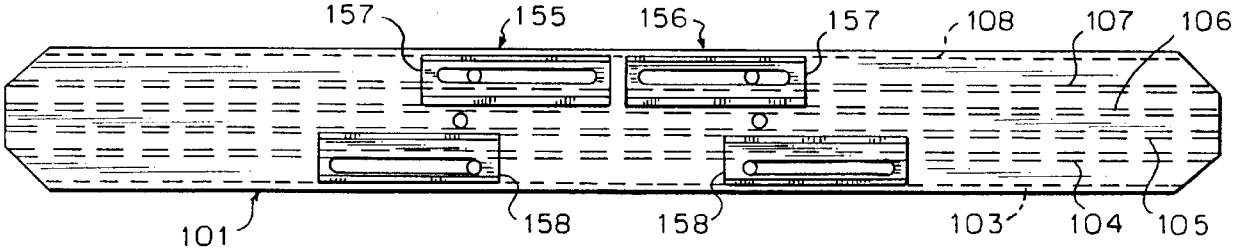
FIG. 20 shows a bottom view of the base plate of the means according to FIG. 4, two two-part spacer pieces being assigned thereto.
Figure 22:
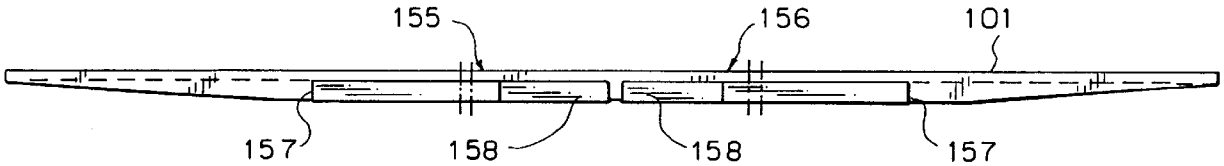
FIG. 22 shows a side view of the arrangement from FIG. 20.
Figure 27:
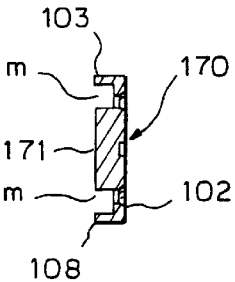
FIG. 27 shows a vertical section through the last-mentioned base plate.

FIG. 20 shows a bottom view of the base plate 101 of the means in question, two two-part spacer pieces 155 and 156 being assigned thereto. The base 160 of the respective part 157 or 158 of the spacer piece 155 or 156 is only wide enough for the outer side of the first leg 161 of the U-profile to butt against the inner side of one of the outer ribs 103 or 108 of the base plate 101 and for the outer side of the second leg 162 of the U-profile to butt against the outer side of one of the central ribs 105 or 106. The base 160 of the respective spacer-piece part 157 or 158 is thus only wide enough for the base 160 to span the wide gap M (FIG. 6) and only one of the narrow gap L between the ribs 103 to 108 of the base plate 101. The fastening screw 125 passes through the wide gap M. As a result, the slot 163, which is made in the base 160 and through which the screw 125 likewise passes, is located closer to one of the legs 161 or 162 of the U-shape. It can be seen from FIGS. 21, 22 and 23 how the spacer-piece parts 157 and 158 are specifically assigned to the base plate 101. This assignment corresponds at least essentially to that which has already been described above.

FIG. 18 shows a plan view of a second embodiment of the two-part spacer piece 165, this being the same as the spacer piece 155 according to FIG. 17 apart from the design of the opening in the base 160. The opening in the base 160 is designed as a row of closely following bores 166, as has already been described in conjunction with FIG. 15. The purpose of these bores 166 is to prevent the set position of the spacer-piece part 157 or 158 from changing during the period over which the means is in use.

Figure 24:
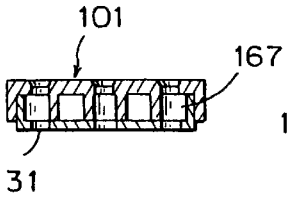
FIG. 24 shows a vertical section of a further embodiment of the arrangement from FIG. 13 with single-part spacer pieces, the section being taken perpendicularly to the longitudinal direction of this arrangement.

If the parts 157 and 158 of the spacer pieces 155 and 156 are designed as in shown in FIG. 17, then said parts 157 and 158 can be fixed in that bores are made in the at least one of the legs 161 and 162 and in the outer ribs 103 and 108 of the base plate 101, a fastening screw 167 or a pin passing through said bores. The abovementioned closely situated rows of bores are made in the legs 161 and 162, while in each case one bore per spacer piece 155 or 156 suffices in the rib 103 or 108. FIG. 24 shows the use of the bores which have just been described and of the associated connecting screw 167 in the case where the spacer piece 131 is wide, i.e. when the latter extends over the entire width of the base plate 101.

Figure 25:
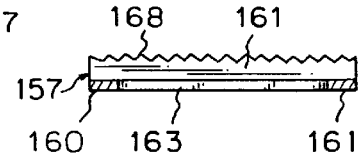
FIG. 25 shows a vertical section of one of the spacer pieces, or one of the parts of one of the spacer pieces, which has a toothed edge.

FIG. 25 shows a vertical section of a further possible embodiment of the first part 157 of the first spacer piece 155. For fixing said spacer-piece part 157 beneath the base plate 101, that edge of the leg 161 which faces the base plate 101 has teeth 168. When the fastening screw is tightened, these teeth 168 are pressed into the base of the gap M or L between the relevant ribs of the base plate, this resulting in the position of the said part 157 being fixed with respect to the base plate 101. It goes without saying that both the legs 161 and 162 of all the parts 157 and 158 of the divided spacer pieces 155 and 156 and the legs 134 and 135 of the wide spacer pieces 131 and 132 may be provided with such teeth 168.

Figure 26:
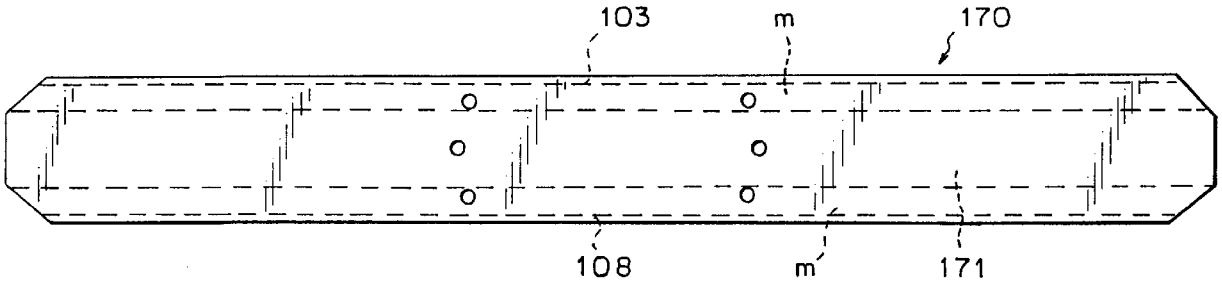
FIG. 26 shows a plan view of a particularly stiff embodiment of the base plate of the means according to FIG. 4.

FIG. 26 illustrates a further embodiment of the base plate 170, which is particularly stiff and can be used for the means in question. This base plate 170 has the abovedescribed plate part 102, the outer ribs 103 and 108 projecting downward from the borders thereof. Instead of the abovedescribed individual central ribs 104 to 107, the present base plate 170 has a single rib 171, which is approximately as wide as all the central ribs 104 to 107 together. The wide gap M is also present in this case between the respective outer ribs 103 or 108 of the base plate 170 and the respectively facing side surface of the wide rib 171. The underside of this base plate is otherwise formed in the same manner as the underside of the base plate according to FIG. 5.

Figures 28, 29, 30, 31, 32:
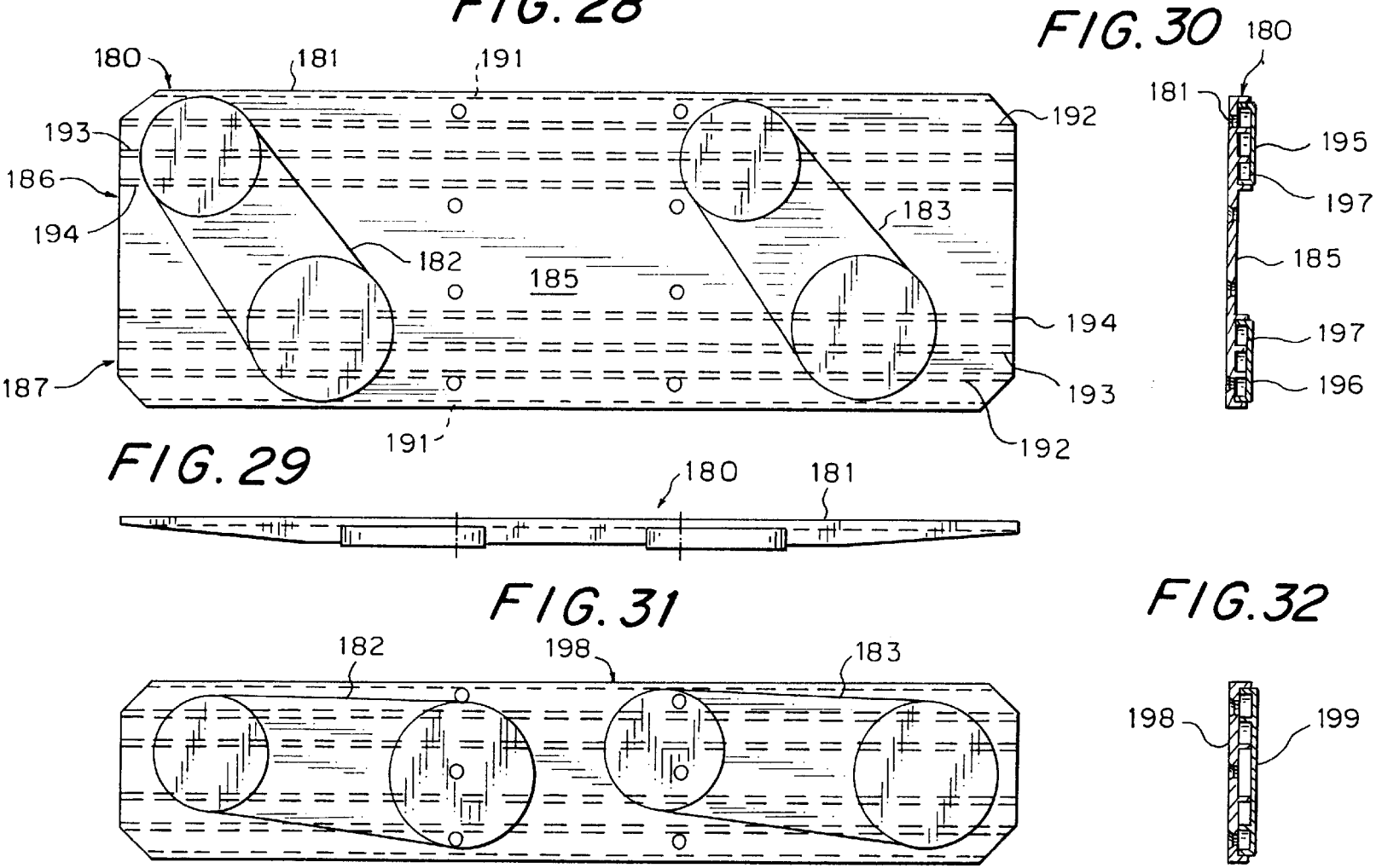
FIG. 28 shows a plan view of the base plate of the means according to the invention which is intended for a snowboard.
FIG. 29 shows a side view of the arrangement according to FIG. 28, the base plate being provided with two spacer pieces.
FIG. 30 shows a front view of the arrangement from FIG. 29.
FIG. 31 shows a plan view of the base plate of the means according to the invention which is intended for a monoski.
FIG. 32 shows a front view of the arrangement from FIG. 31, and FIGS. 33 to 35 show a further embodiment of this means.

FIG. 28 shows a plan view of an embodiment of the means according to the invention which can be fitted on a snowboard. This means is illustrated in side view in FIG. 29 and in a front view in FIG. 30. The transmission device 180 of said means comprises a base plate 181, the width of which is selected such that bindings 182 and 183 for the boots of the snowboarders [sic] may be positioned on the upper side of the base plate 181. The base plate 181 comprises a plate part 185, from which two groups 186 and 187 of ribs project downward. The respective group 186 or 187 comprises an outer rib or rib border 191 and three inner ribs 192, 193 and 194. The distances between the ribs 191 to 194 of a group 186 or 187 are equal. The groups 186 and 187 of ribs are spaced apart by a distance which is larger than the distance between two adjacent ribs of the same group, with the result that the underside of the plate part 185 is planar between the groups 186 and 187 of ribs.

The spacer pieces 195 and 196 of this embodiment are divided spacer pieces and may essentially be designed as has been described in conjunction with FIG. 17 and the following figures. However, the base 197 of the respective part 195 or 196 of the spacer pieces is wider than in the case of the abovedescribed spacer pieces, in accordance with the width of a snowboard.

FIG. 31 shows a plan view of a transmission device which can be used on so called monoski. FIG. 32 shows a front view of this means. The base plate 198 of this means is of essentially the same design as the base plate 101 of the means according to FIG. 4, although the present base plate 198 is somewhat wider. The same also applies to the spacer pieces 199.

Figure 33:
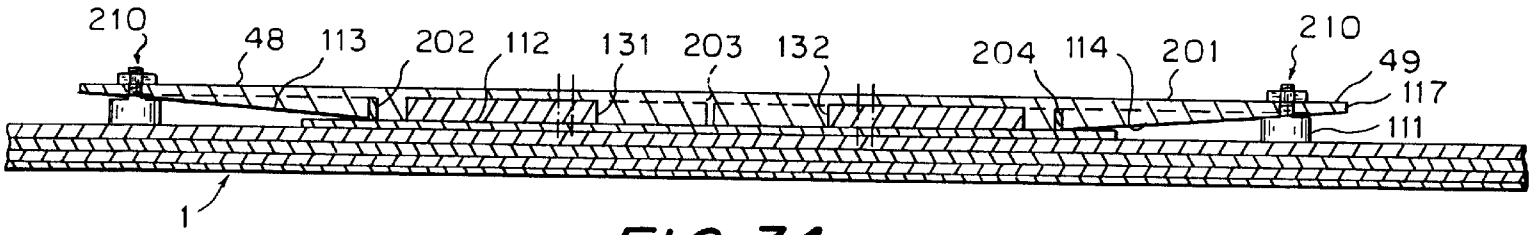
Figure 34:
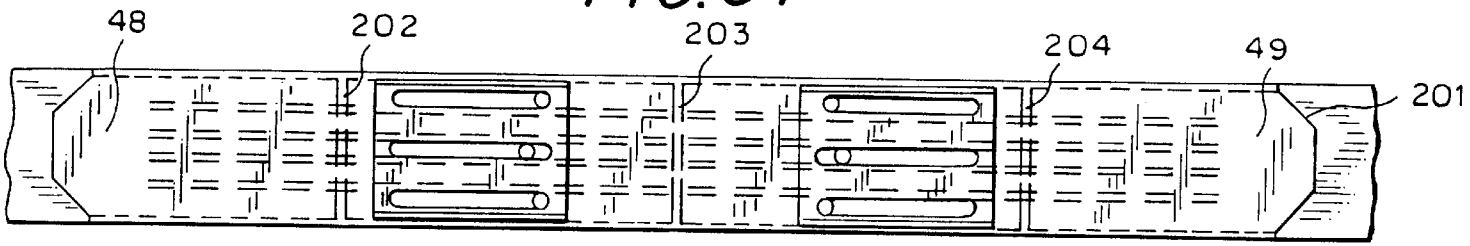
Figure 35:
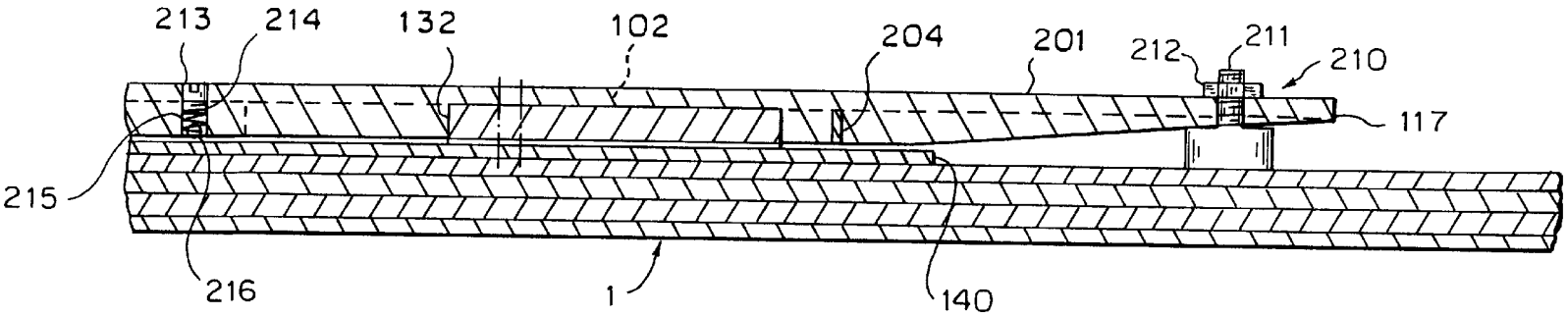

FIG. 33 shows a side view of a detail from the central part of a ski which is equipped with a further embodiment of the means according to the invention. FIG. 34 shows a plan view of the transmission plate of the means according to FIG. 33. FIG. 35 shows a side view, an enlarged scale, of approximately half of the transmission plate of FIG. 33, which is provided with a specially designed central scew.

The base plate 201 of the means according to FIG. 33 differs from the base plate 101 according to FIGS. 4 to 7, in particular, in that it has transverse ribs 202, 203 and 204. These transverse ribs 202 to 204 run perpendicularly to the longitudinal direction of the base plate 201 and the longitudinal ribs 103 to 108 and are distributed over the length of the base plate 201. The central transverse rib 203 is located virtually in the center of the length of the base plate 201. The respective outer transverse rib 202 or 204 is located between the center and the relevant end edge 116 or 117, respectively, of the base plate 201. In the case illustrated, the respectively outer transverse rib 202 or 204 is located in the region of the transition between the horizontal section 112 and the upwardly sloping section 113 or 114, respectively, of the longitudinal ribs 103 to 108. The transverse ribs 202 to 204 increase the torsional rigidity of the base plate 201. The base plate 201 may have a smaller number or larger number of transverse ribs than is indicated here.

Impact dampers 210 are provided, in each case one of which is assigned to one of the end parts 48 and 49 of the base plate 201. These impact dampers 210 may be designed as hydraulic dampers. The respective damper 210 is located between the relevant end part 48 or 49 of the base plate 201 and the ski body 1. In the upper region, the damper 210 has a screw-bolt 211 which passes through a corresponding opening in the end party [sic] 48 or 49 of the base plate 201 and is firmly secured to the base plate 201 with the aid of a nut 212. That end part of the damper 210 which faces the ski body 1 rests on the upper side of the ski body 1 and can be firmly secured to the ski body 1.

FIG. 35 shows a central screw 213, which is illustrated in partial vertical section. This screw 213 corresponds to the central screw 143 which has been described above in conjunction with FIG. 8. The present central screw 213 is screwed in the plate part 102 of the base plate 201 and has a hollow bolt 214 which opens toward the ski body 1. A strong spring 215 is accommodated in the interior of said screw-bolt 214. A ball 216 is arranged in the area where the cavity in the screw-bolt 214 opens out, and the spring 215 presses on said ball. When said central screw 213 is screwed in to the depth which is required for the initial setting of the transmission device, then the spring 215 yields somewhat if the transmission device is subjected at any time to overloading, which could result in damage to the ski body 1 by an excessive pressure of the screw 213.

The plate 140, on which the spacer pieces 131 and 132 rest, is an energy-storage plate as well as a pressure-distributing plate. This means that this plate 140 absorbs the energy released during bending of the ski body 1 and returns this energy to the ski body 1 again when the latter is relieved of pressure. This has the result that, although the markedly narrowed ski body 1 can bend easily, it resumes its original form quickly once relieved of pressure. This energy-storage plate 140 may be made of spring steel or a plastic with properties similar to those of spring steel. Such a plate 140 is firmly secured to the upper side of the ski body 1. The plate can be secured by adhesive bonding, expediently in a compliant manner. The plate can be secured, for example, by using double-sided adhesive tape.

In order that the spacer pieces 131 and 132 (FIG. 10) can butt against one another, at least one of the border parts of the base 133 of said spacer pieces 131 and 132 is provided with an approximately semicircular recess 148, which adjoins one of the end edges 149 of the spacer piece 131 or 132, said end edges connecting the legs 134 and 135 of the spacer piece. The radius of the recess 148 corresponds to the radius of the central screw 143 or 213. It is true, in principle, that the more the basic body of the snowboard or ski is narrowed, the more advantageous the effect of the means according to the invention on the functioning of said snowboard or ski. An important advantage of the means according to the invention is that, without changing the position of the binding with respect to the ski body, the force transmission between the boot 6 and ski body 1 can be set optimally in accordance with requirements by displacing the spacer pieces.

I claim:

1. An arrangement for securing a snowboard or ski to a boot of the snowboarder or skier, comprising a transmission device (50; 100) which transmits forces from the boot (6) into a narrowest region (5) of a width of the snowboard or ski (1), the transmission device (50; 100) having an elongate base plate (53; 101) on which there is fitted a binding (11, 12) for fastening the boot (6), the transmission device (100) further comprising two spacer pieces (131, 132) which are engaged to the base place (101) and to the ski body (1), the spacer pieces (131, 132) being adjustably engaged in a central region of the base plate (101) for longitudinal movement relative to the base plate, and being spaced apart from one another by a distance (F) and from a center of the base plate (101), wherein the base plate (101) has a plate portion (102) and a plurality of ribs (103, 104, 105, 106, 107 and 108) which project downward from the plate portion, the plurality of ribs (103 to (108) extending in the longitudinal direction of the base plate (101), sides of the spacer pieces (131, 132) being engaged to two outermost ribs (103, 108) of said plurality of ribs, and an outer side of each of said spacer pieces (131 or 132) facing an upper side of the ski body (1).

2. The arrangement according to claim 1, wherein the plurality of ribs (103 to 108) are integral with the plate portion (102) of the base plate (101), the plurality of ribs being distributed over a width of the plate portion (102) and spaced apart from one another, said plurality of ribs being parallel to one another and parallel and perpendicular to the longitudinal direction of the elongate base plate (101), and having an essentially square cross section.

3. The arrangement according to claim 1, wherein a bore (120) is made approximately in a center of the plate portion (102), a first and a second group (121 or 122) of bores (123, 124, 125) located in the plate portion (102), the first group of bores being spaced apart from said central bore (120), wherein said first group of bores (121) is located between the central bore (120) and a front end (116) of the base plate (101) and the second group of bores (122) is located between the central bore (120) and a rear end (117) of the base plate, and a distance between said first and said second group of bores (123, 124 and 125) is smaller than a distance between parts (11, 12) of a binding mounted on the base plate (101).

4. The arrangement according to claim 3, wherein the bore 120 is a threaded bore.

5. The arrangement according to claim 3, wherein outer bores 123, 124 of said first and said second group of bores is located in a region of a gap M between the outermost plurality of ribs and the central plurality of ribs and that a middle bore 125 of said first and said second group of bores located between the outer bores, is arranged in a central gap L between the central plurality of ribs.

6. The arrangement according to claim 5, wherein the bores are arranged on a common line which is at right angles to a longitudinal axis of the plate part 102, the middle bore being arranged so as to be offset away from the common line toward a nearest end of ends of the plate portion 102 and that a distance between the groups of bores is smaller than a length of the first rib section 112 of the plurality of ribs.

7. The arrangement according to claim 3, wherein the base plate 102 and the spacer pieces 131, 132 are retained on the ski body 1 by screws which pass through the first and the second group of bores, and the slots 136–138 to engage the ski body 1.

8. The arrangement according to claim 3, wherein a further screw 143 passes through the central bore 120 in the base plate 101, and rests on the ski body 1 and that said screw 143 is located between the spacer pieces 131, 132, arranged on the ski body 1.

9. The arrangement according to claim 1, wherein each of said spacer pieces (131, 132) has a U-shaped cross section with a base (133) and with legs (134, 135) said base having longitudinal slots (136, 137, 138; 163) which run parallel to a longitudinal axis of the legs, the position of said longitudinal slots corresponding to a position of the bores (123, 124, 125) on the base plate (101), and a height of the legs (134, 135; 161, 162) being comparable with the height of the plurality ribs (103 to 108) on the base plate (101).

10. The arrangement according to claim 1, wherein a pressure-distributing plate (140) is fastened on the upper side of the ski body (1), said plate (140) being adhesively bonded on the upper side of the ski body (1), and the spacer pieces (131, 132) resting on the upper side of said distributing plate.

11. The arrangement according to claim 1, wherein each of the plurality of ribs comprise a first, second and third rib section (112, 113, 114), the first section (112) having a free edge (111) which runs parallel to an upper side (115) of the plate portion (102), said first rib section (112) being longer than the second and the third rib section (113, 114), the second and third section rib section (113, 114) extending from the first rib section (112) to a corresponding end (116, 117) of the plate portion (102), wherein the second and third rib section (113, 114) slope up from the first rib section (112) toward the corresponding end (116, 117) of the plate portion (102).

12. The arrangement according to claim 1, further comprising a damping device (30) comprising an elongated cover plate (31) fitted on the ski body (1), and a damping plate (33) made of a compliant material arranged between the cover plate (31) and the ski body (1), wherein, the transmission device is fitted on said damping device.

13. The arrangement according to claim 1, wherein a bore (130) is made at least in one of end (116, 117) of the base plate (101) at a center of a width of said end, wherein a block (150) made of a damping material is arranged at said end located beneath said bore (130), the block being embedded in an insert (144, 145) between said base plate and said ski body.

14. The arrangement according to claim 1, wherein a width of said base plate 101 is approximately the same as a width of the central section (5) of the ski body, and that said plurality of ribs (103–108) project at right angles from an underside of the plate portion 102.

15. The arrangement according to claim 1, wherein an outer side surface (109, 110) of the outermost plurality of ribs (103, 108) is located on a respective longitudinal border of the plate portion 102, and is flush with an abutting side edge of the plate portion 102.

16. The arrangement according to claim 1, wherein central plurality of ribs (104–107) of said plurality of ribs form a group located between the outermost plurality of ribs (103, 108) and are concentrated in a central region of a gap between the outermost plurality of ribs, the central plurality of ribs being spaced apart by a distance L which is smaller than a distance M between the central plurality of ribs and the outermost plurality of ribs.

17. The arrangement according to claim 16, wherein the central plurality of ribs are shorter than the outermost plurality of ribs so that the underside of the plate portion 102 is planar in an end region of said plate portion 102, and wherein the outermost plurality of ribs terminate at a respective phase 126 at ends of the plate portion (116, 117).

* * * * *